US006615781B2

(12) United States Patent
Tanaka et al.

(10) Patent No.: US 6,615,781 B2
(45) Date of Patent: Sep. 9, 2003

(54) OVERHEAD CAMSHAFT TYPE VALVE TRAIN FOR INTERNAL COMBUSTION ENGINE

(75) Inventors: Shigekazu Tanaka, Saitama (JP); Toshiyuki Sato, Saitama (JP); Naoki Takahara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,043

(22) Filed: Mar. 27, 2002

(65) Prior Publication Data

US 2002/0139336 A1 Oct. 3, 2002

(30) Foreign Application Priority Data

Mar. 27, 2001 (JP) ..... P.2001-089345

(51) Int. Cl.[7] ..... F01L 1/02

(52) U.S. Cl. ..... 123/90.27; 123/90.39; 123/90.43; 123/90.45

(58) Field of Search ..... 123/90.15, 90.16, 123/90.39, 90.4, 90.41, 90.43, 90.44, 90.45, 90.36, 90.27

(56) References Cited

U.S. PATENT DOCUMENTS 4,530,318 A * 7/1985 Semple ..... 123/90.17
4,913,105 A * 4/1990 Kawasaki ..... 123/90.46
4,915,066 A * 4/1990 Koshimoto et al. ..... 123/90.27
5,297,506 A 3/1994 Reckzügel et al.
5,562,072 A * 10/1996 Stoody, Jr. ..... 123/90.27

FOREIGN PATENT DOCUMENTS

JP 6-34563 9/1994

* cited by examiner

*Primary Examiner*—Thomas Denion
*Assistant Examiner*—Jaime Corrigan
(74) *Attorney, Agent, or Firm*—Arent Fox Kintner Plotkin & Kahn

(57) ABSTRACT

An overhead camshaft type valve train includes drive rocker arms interlockingly connected to intake valves (exhaust valves) rockingly supported on a rocker shaft fixed to camholders for rotatably supporting a camshaft, free rocker arms adapted to get free relative to the intake valves (exhaust valves), connection switching mechanisms for switching over the connection and release of connection between the drive rocker arms and the free rocker arms, and lost motion mechanisms for biasing the free rocker arms to a cam side. The respective cam holders are fastened to the cylinder head by pairs of fastening portions with bolts, and holding portions for holding the lost motion mechanisms are formed integrally with the fastening portions.

25 Claims, 8 Drawing Sheets

OVERHEAD CAMSHAFT TYPE VALVE TRAIN FOR INTERNAL COMBUSTION ENGINE

BACKGROUND OF THE INVENTION

1. Field of the Invention

The present invention relates to an overhead camshaft type valve train for an internal combustion chamber which includes rocker arms for driving engine valves, and more particularly to an overhead camshaft type valve train including biasing means for biasing the rocker arms to either a cam side or an engine valve side.

2. Description of the Related Art

Conventionally, as an overhead camshaft type valve train including rocker arms for driving engine valves, Japanese Utility Model Publication No. 34563/1994 discloses an overhead camshaft type valve train for an internal combustion engine having biasing members for biasing the rocker arms to a cam side. This overhead camshaft type valve train includes intake side and exhaust side valve trains having the same construction. The intake side valve train for each cylinder includes a pair of drive rocker arms, a free rocker arm and a connection switching mechanism. The pair of drive rocker arms are brought into sliding contact with two low-speed cams, respectively, provided on a camshaft rotatably supported by cam holders fastened to a cylinder head and are interlockingly connected to a pair of intake valves, respectively. The free rocker arm is situated between the two drive rocker arms to be brought into sliding contact with a high-speed cam. The connection switching mechanism switches over the connection and release of connection of the drive rocker arms and the free rocker arm. Since the free rocker arm moves idly irrespective of the intake valve when the engine is driven at low speeds, in order to prevent the rough action thereof, a lost motion mechanism (corresponding to the biasing member) is provided on the intake side valve train for biasing the free rocker arm to the high speed cam side, and the lost motion mechanism is held in a holding portion having a recessed portion formed in the cylinder head.

Incidentally, according to the related art, since the holding portion for the lost motion mechanism is formed in the cylinder head, the construction of the cylinder head becomes complicated in which fixing portions for valve guides for slidingly guiding the intake valve and the exhaust valve and accommodation cylinders for accommodating spark plugs are formed, and there is caused a problem that productivity is decreased. In addition, since a space for the holding portion needs to be secured, the compact layout of the fixing portions, the accommodating cylinders and moreover valve springs becomes difficult, and this causes a further problem that the cylinder head is enlarged, this leading to the enlargement of the valve train chamber and eventually the internal combustion engine. To cope with this, in order to simply the construction of the cylinder head without forming the holding portions in the cylinder head so as to improve the productivity and realize a compact layout of the fixing portions, the accommodating cylinders and the valve springs, it is contemplated that a member is separately prepared in which a holding portion is formed for attachment to the cylinder head. However, the valve train chamber and hence the internal combustion engine are enlarged to such an extent that the additional member is attached thereto, and in the event that the internal combustion engine is enlarged, the weight thereof is increased. Moreover, the number of components is increased and hence the assembling man hours are also increased, leading to the deterioration of assembling performance.

On the other hand, a load is exerted to the holding portion for holding the lost motion mechanism, from the free rocker arm which is rocked when brought into sliding contact with the high speed cam. Therefore, it is desirable that the deformation of the cylinder head in which the holding portions are formed due to the load so exerted is made as small as possible and that a biasing force which is stable in a certain direction is exerted to the free rocker arm. Accordingly, the thickness of a peripheral portion of the member where the holding portion is formed needs to be increased, or reinforcement ribs are formed in such a manner as to connect to the holding portion in the peripheral portion of the holding portion so that the rigidity can be increased. As a result of such efforts, the cylinder head is made large in size and heavy in weight, thus causing a problem increasing the size and weight of the internal combustion engine.

Further, U.S. Pat. No. 5,297,506 discloses a valve operating system in which a holding portion for holding a spring is provided in a cam holder. However, according to U.S. Pat. No. 5,297,506, the holding portion is protruded from the cam holder, thus causing a problem increasing the size of the internal combustion engine.

SUMMARY OF THE INVENTION

The invention was made in view of the situations, and an object of the invention is to reduce the size and weight of a cylinder head on which an overhead camshaft type valve train having biasing members held at holding portions is provided, leading eventually to provision of an overhead camshaft type valve train for an internal combustion engine which can reduce the size and weight of the internal combustion engine.

With a view to attaining the object, according to a first aspect of the invention, there is provided an overhead camshaft type valve train for an internal combustion engine including: a camshaft supported by a plurality of holders provided on an cylinder head; rocker arms mockingly supported on a rocker shaft for driving engine valves to open; cams provided on the camshaft for regulating the rocking action of the rocker arms; and biasing members for biasing the rocker arms to either a cam side or an engine valve side, wherein at least one of the plurality of holders is fastened to the cylinder head with fastening members at two fastening portions spaced apart from each other in an orthogonal direction which intersects at right angles with an axial direction of the rocker shaft when viewed from a plane, and wherein the at least one of holders includes a holding portion for holding the biasing member, which is integrally formed on at least one of the two fastening portions.

According to the first aspect of the invention, the following advantage can be provided. Namely, the holding member for holding the biasing member is formed on the holder fastened to the cylinder head for supporting the shaft member which is a constituent component of the valve train, the construction of the cylinder head is simplified to improve the productivity of cylinder heads. Moreover, since there is no need to prepare a separate member for forming the holding portion for attachment to the cylinder head, the number of components is reduced to improve the assembling efficiency of internal combustion engines, and at the same time the size and weight of an internal combustion engine so produced can be reduced. Furthermore, since the fastening portion where the holding portion is formed integrally is a portion where the holder with the holding portion is fastened to the cylinder head with the fastening member, the deformation generated in the fastening portion where the holding portion is formed by virtue of a load exerted from the rocker arm to the holding portion via the biasing member is extremely small, and the biasing force which is stable in the certain direction can be exerted to the rocker arm. Thus, since the deformation amount of the holder with the holding portion due to the load exerted to the holding portion is made as mall as possible by making use of the fastening portion, there is almost no need to form a thicker portion on the holder or reinforcement ribs that would otherwise be needed due to the formation of the holding portion on the holder, whereby the holder with the holding portion can be made small in size and light in weight, this leading to an internal combustion chamber which is small in size and light in weight. Moreover, since the holding portion is integrally formed on the fastening portion, the rigidity thereof can be improved further.

According to a second aspect of the invention, there is provided an overhead camshaft type valve train for an internal combustion engine according to the first aspect of the invention, wherein the rocker arm is disposed between two of the holders which are adjacent in the axial direction, wherein at least one of the two holders is the holder including the holding portion, and wherein a center axis of the fastening member at the one of the fastening portions on the one of the two holders is situated on an opposite side to a side where the holding portion is situated, in relation to a reference straight line passing through a center point in the axial direction between a center axis of the fastening member at the one of the fastening portions on the one of the two holders and a center axis of the fastening member at the other fastening portion of the two fastening portions as viewed from the plane and being parallel to the orthogonal direction.

According to the second aspect of the invention, in addition to the advantage provided by the first aspect of the invention, the following advantage can be provided. Namely, in the holder with the holding portion which is one of the two holders provided in such a manner as to hold therebetween the rocker arm, since the center axis of the fastening member at the fastening portion where the holding portion is formed is situated on the opposite side to the side where the holding portion is formed in relation to the reference straight line, the space in the axial direction between the holding portion and the other holder can be increased accordingly, and therefore, the sufficient space for disposition of the rocker arm can be secured without increasing the space between the two holders in the axial direction, namely, without increasing the width of the cylinder head in the axial direction while maintaining the small size and light weight of the cylinder head.

According to the third aspect of the invention, there is provided An overhead camshaft type valve train for an internal combustion engine including: a camshaft supported by a plurality of holders provided on an cylinder head; drive rocker arms rockingly supported on a rocker shaft in such a manner as to be interlockingly connected to respective engine valves comprising an intake valve and an exhaust valve so as to drive the engine valves to open; free rocker arms supported mockingly on the rocker shaft in such a manner as to have a free condition relative to the engine valves; cams provided on the camshaft for regulating the rocking actions of the drive rocker arms and the free rocker arms; connection switching mechanisms for switching over the connection and the release of connection of the drive rocker arms and the free rocker arms; and biasing members for biasing the free rocker arms to a cam side, wherein at least one of the plurality of holders is fastened to the cylinder head with fastening members at two fastening portions spaced apart from each other in an orthogonal direction which intersects at right angles with an axial direction of the rocker shaft when viewed from a plane, wherein the at least one of holders includes a holding portion for holding the biasing member, which is integrally formed on at least one of the two fastening portions, and wherein the free rocker arm is disposed closer to the holder including the holding portion in the axial direction than the drive rocker arm.

According to the third aspect of the invention, in the overhead camshaft type valve train for driving the engine valves comprising the intake valves and exhaust valves, in addition to the advantage provided by the first aspect of the invention, the following advantage can be provided. Namely, since the free rocker arm is disposed in the vicinity of the holder with the holding portion in the axial direction, the protruding amount of the holding portion for holding the biasing member for biasing the free rocker arm from the holder may be small. Therefore, in this respect, too, the holder is made small in size and light in weight, and hence the internal combustion engine is made small in size and light in weight.

According to a fourth aspect of the invention, there is provided an overhead camshaft type valve train for an internal combustion chamber according to any of the first to third aspects of the invention, wherein a side wall of the holding portion extends along a fastening direction of the fastening member.

According to the fourth aspect of the invention, in addition to the advantages provided by the aspects of the invention so cited, the following advantage can be provided. Namely, since the side wall of the holding portion is formed in such a manner as to extend along the fastening portion along the fastening member, the connecting range between the holding portion and the fastening portion can be set large in the fastening direction, whereby the advantage provided by the first aspect of the invention can be improved further.

According to a fifth aspect of the invention, there is provided an overhead camshaft type valve train for an internal combustion engine according to any of the first to fourth aspects of the invention, wherein the holding portions are formed on the two fastening portions at positions which hold the shaft member therebetween and wherein one of the holding portions is situated on one side of the holder in the axial direction whereas the other holding portion is situated on an opposite side of the holder in the axial direction.

According to the fifth aspect of the invention, in addition to the advantages provided by the aspects of the invention so cited, the following advantage can be provided. Namely, since the load exerted from the rocker arm pushed by the cam to the two holding members is allowed to be exerted to the holder with the holding portion at the positions which are spaced apart in the orthogonal direction in such a manner as to hold therebetween the shaft member, as well as to the both sides thereof in the axial direction, the points to which the load is exerted on the holder can be dispersed to reduce the stress that would be otherwise generated by the load, this facilitating the design of the holder and also increasing the durability of the holder.

According to a sixth aspect of the invention, there is provided an overhead camshaft type valve train for an internal combustion engine according to any of the first to fifth aspects of the invention, wherein a recessed portion is formed between the fastening portion and the holding portion.

According to the sixth aspect of the invention, in addition to the advantages provided by the aspects of the invention so cited, the following advantage can be provided. Namely, since the recessed portion is formed between the fastening portion and the holding portion, the holder with the holding portion is made light in weight, this eventually leading to an internal combustion engine which is made light in weight.

According to a seventh aspect of the invention, there is provided an overhead camshaft type valve train according to any of the first to sixth aspects of the invention, wherein the holding portion on the holder with a holding portion protrudes in the axial direction from one of sides, as viewed from the plane, of the holder with a holding portion situated between the two fastening portions, and wherein part of a holding hole formed in the holding portion for accommodation of the biasing member is situated closer to the other side of the holder in the axial direction than the one of sides of the holder.

According to the seventh aspect of the invention, in addition to the advantages provided by the aspects of the invention so cited, the following advantage can be provided. Namely, since part of the holding hole is situated closer to the other side of the holder with the holding portion than the one side thereof, the protruding amount of the holder protruding from the one side thereof in the axial direction is made small, and the holder is made light in weight. Furthermore, the width of the cylinder head in the axial direction becomes small, whereby the cylinder head is made small in size and light in weight, this eventually leading to an internal combustion engine which is made small in size and light in weight.

Note that in this specification, when referred to "when or as viewed from a plane" this means viewing from a direction of a center axis of a cylinder of the internal combustion engine.

DETAILED DESCRIPTION OF THE PREFERRED EMBODIMENTS

Referring to FIGS. 1 to 8, an embodiment of the invention will be described.

An internal combustion engine to which an overhead camshaft type valve train according to the invention is applied is a SOHC type in-line four-cylinder four-cycle internal combustion engine which is designed to be installed on a vehicle, and constitutes a hybrid engine together with an electric motor which is also designed to be installed on the vehicle for driving the same.

Figure 1:
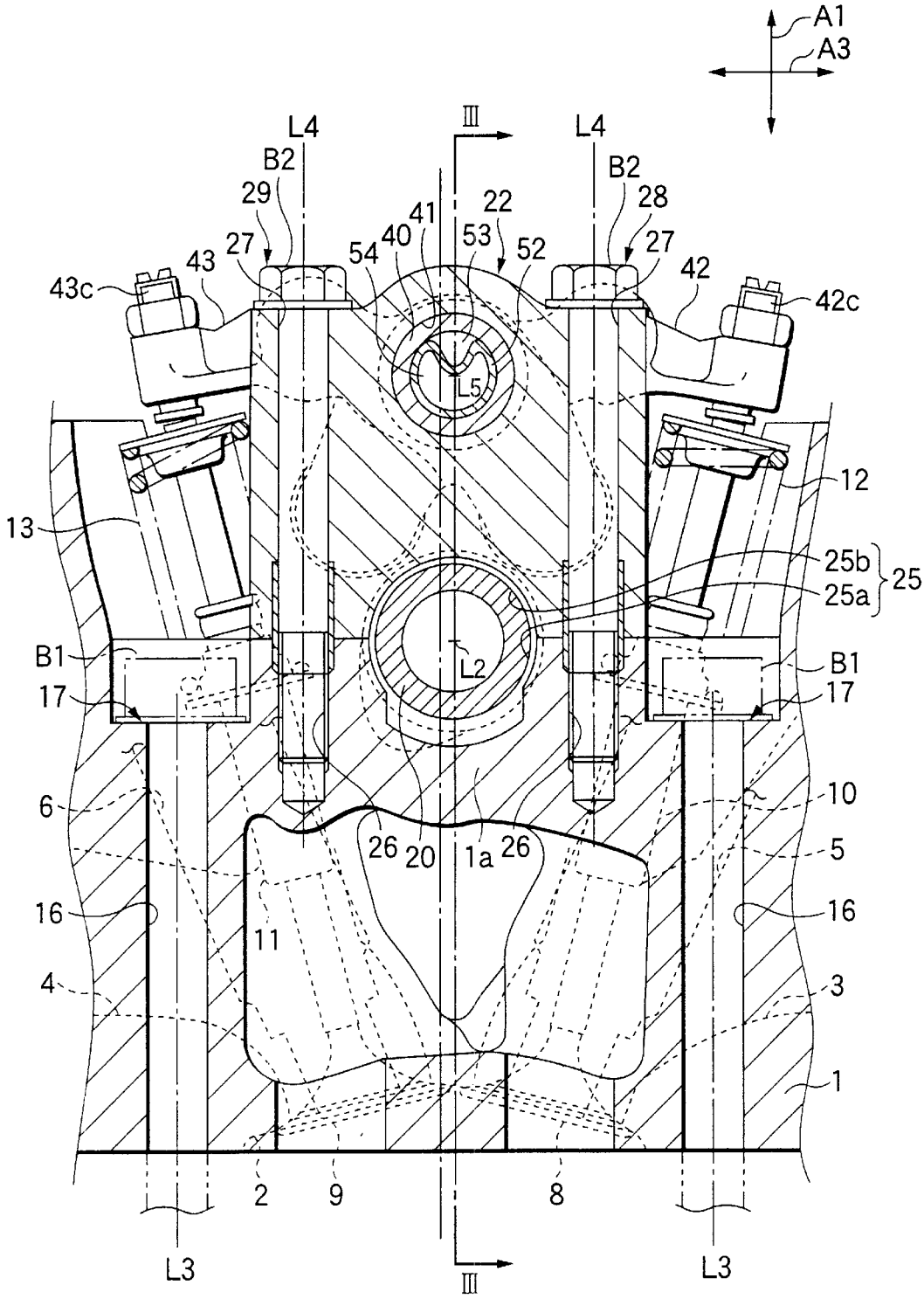
FIG. 1 is a vertical sectional view of an overhead camshaft type valve train according to the invention, which is taken along the line I—I in FIG. 2.
Figure 2:
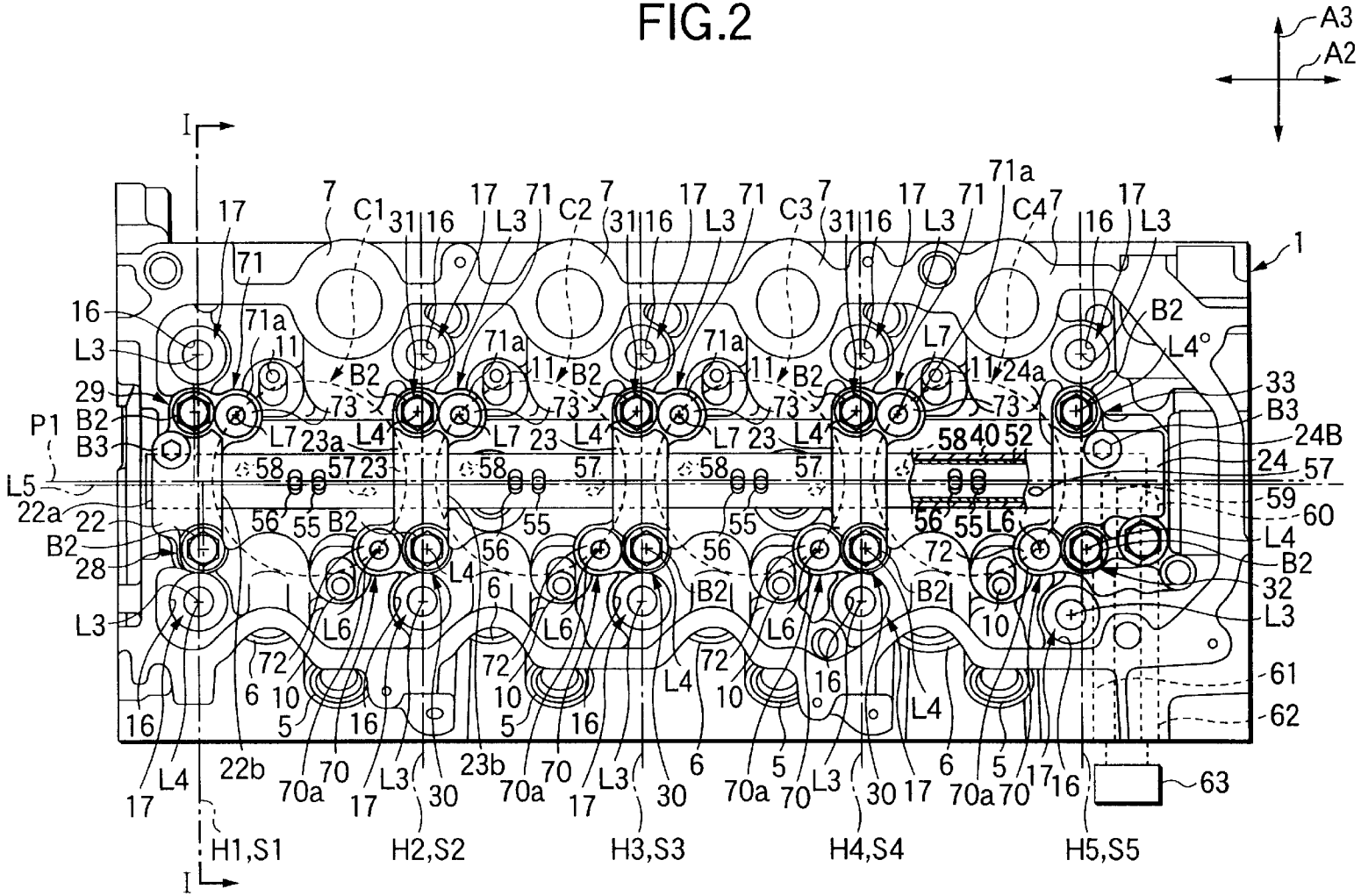
FIG. 2 is a plan view of a cylinder head.
Figure 3:
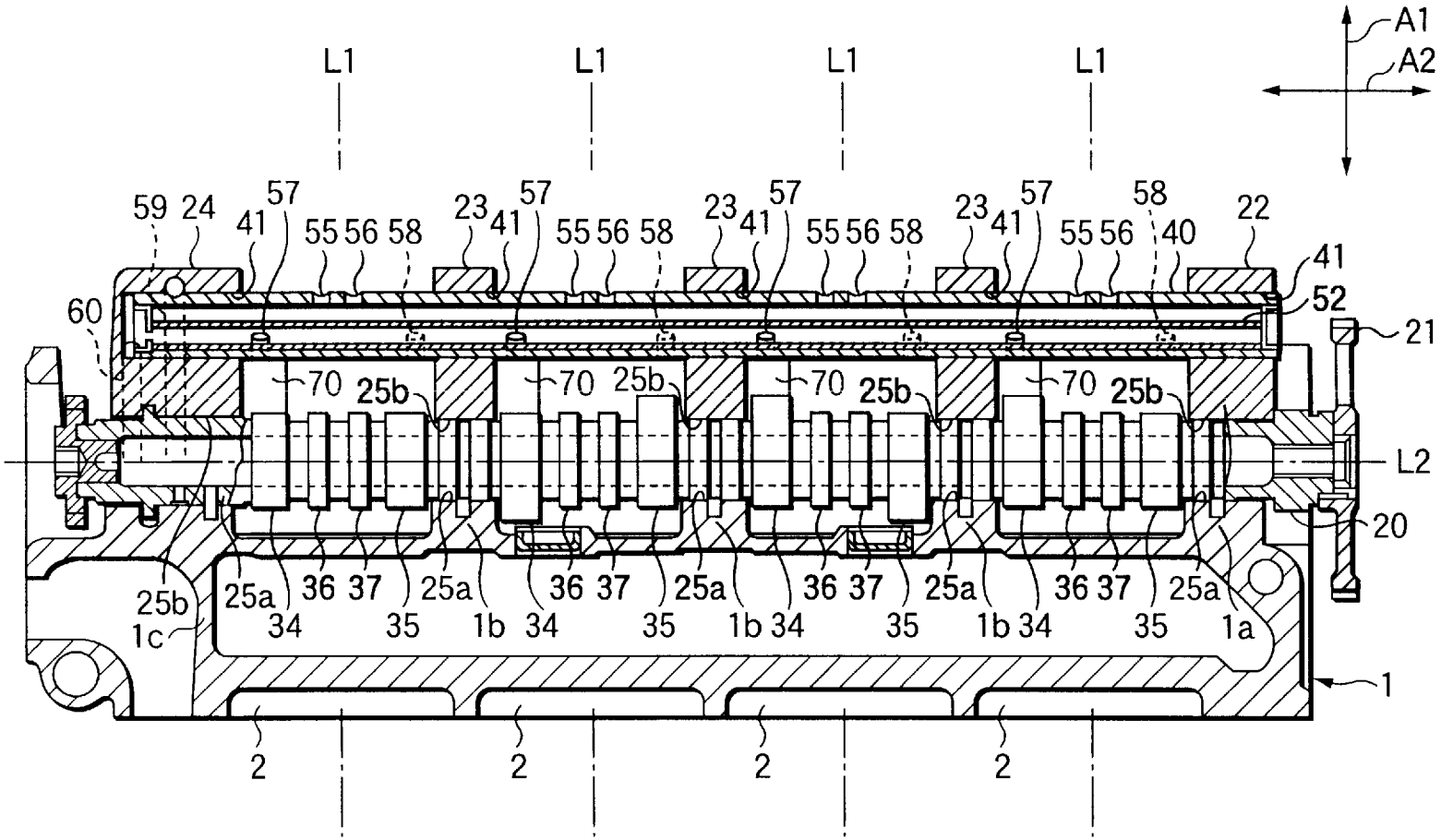
FIG. 3 is a sectional view taken along the line III—III in FIG. 1.

Referring to FIGS. 1 to 3, the internal combustion engine includes a cylinder head 1 which is fastened to an upper surface of a cylinder block (not shown) in which four cylinders C1 to C4 are disposed in line. The four cylinders C1 to C4 has pistons (not shown) fitted in such a manner as to reciprocate freely. The cylinder head 1 forms combustion chambers 2 between the respective pistons and the cylinder head itself.

Formed for each combustion chamber 2 in the cylinder head 1 are an intake port 3 which opens to the combustion chamber 2 at an intake opening and an exhaust port 4 which opens to the combustion chamber 2 at an exhaust opening. Furthermore, formed for each combustion chamber 2 in the cylinder head 1 are a mounting portion 5 where a fuel injection valve is mounted which faces the intake port 3 and two accommodation cylinders 6, 7 having bores into which two spark plugs are inserted which face the combustion chamber 2. An intake valve 8, which is an engine valve for opening and closing the intake opening, and an exhaust valve 9, which is an engine valve for opening and closing the exhaust opening, slidably fit in valve guides 10, 11 fixed to the cylinder head 1, respectively. The intake valve 8 and the exhaust valve 9 are biased toward a valve closing direction by virtue of spring-back force of valve springs 12, 13 being compression coil springs which are mounted between spring receivers placed on the cylinder head 1 and spring receivers provided at end portions of valve stems. The intake valves 8 and the exhaust valves 9 are actuated by a valve train including a camshaft 20, cams 34 to 37 provided on the camshaft 20, a rocker shaft 40 and rocker arms 42 to 45 rockingly supported on the rocker shaft 40. The valve train is accommodated in a valve train chamber formed by the cylinder head 1 and a head cover (not shown) assembled to an upper surface of the cylinder head 1.

Referring to FIG. 2, ten fastening portions 17 as head fastening portions are formed in the cylinder head 1. The fastening portions 17 have through holes 16 which are formed at positions corresponding to threaded holes formed in the cylinder block and each have a center axis L3 which is parallel to a direction A1 of center axes L1 (refer to FIG. 1) of the cylinders C1 to C4 (hereinafter, simply referred to as a"center axis direction A1"). Thus, the cylinder block and the cylinder head 1 are fastened together with bolts B1 (refer to FIG. 1) which pass through the through holes 16 in the fastening portions 17 to be screwed into the threaded holes. Here, the center axis of the bolt B1 matches the center axis L3. The through holes 16 are constituted by two pairs of through holes 16 which are situated at both end portions (an left end portion and a right end portion as viewed in FIG. 2. Hereinafter, when referred to left and right, it always refers to left and right as viewed in FIG. 2) of the cylinder head 1 in a direction A2 of the rotational axis L2 of the camshaft 20 (hereinafter, simply referred to as an "axial direction A2") and three pairs of through holes 16 which are situated in the middle of the adjacent cylinders C1, C2; C2, C3; C3, C4. Each pair of through holes 16 are constituted by the through hole 16 situated on an intake side and the through hole 16 situated on an exhaust side in relation to an imaginary plane P1 which includes the center axes L1 of the four cylinders C1 to C4. The center axes L3 of the fastening portions 17 on the intake side except for the fastening portion 17 at the right end are situated on a straight line which is parallel to the axial direction A2 when viewed from the plane whereas the center axes L3 of the fastening portions 17 on the exhaust side are situated on a straight line which is parallel to the axial direction A2 when viewed from the plane.

Here, the positions of these through holes 16 will be described in relation to reference planes H1 to H5 which will be described below. Firstly, five reference planes H1 to H5 in this embodiment are imaginary planes which intersect at right angles with the axial direction A2, and the cylinders C1, C2, C3, C4 are situated, respectively, between two adjacent reference planes H1, H2; H2, H3; H3, H4; H4, H5 at regular intervals in the axial direction A2. The center axes L3 of the pair of through holes 16 which are situated left to the cylinder C1 are located on the reference plane H1. The center axes L3 of the three pairs of through holes 16 which are situated between the adjacent cylinders C1, C2; C2, C3; C3, C4 are located, respectively, on the reference planes H2 to H4. In addition, as to the center axes L3 of the through holes 16 which are situated right to the cylinder C4, the center axis L3 of the through hole 16 on the exhaust side is located on the reference plane H5 whereas the center axis L3 of the other through hole 16 is located closer to the cylinder C4 than the reference plane H5.

Referring to FIG. 3, the camshaft 20, which is a shaft member having a rotational axis L2 which is parallel to a rotational axis of a crankshaft (not shown) of the internal combustion engine is disposed between the intake valves 8 and the exhaust valves 9 (refer to FIG. 1) in an orthogonal direction A3 which intersects at right angles with an imaginary plane P1. The camshaft 20 is driven to turn one-half the rotational speed of the crankshaft in the cylinder head 1 by virtue of the power of the crankshaft which is transmitted to a cam gear 21 via a series of gear train. The camshaft 20 is rotatably supported on the cylinder head 1 via five supporting walls 1*a* to 1*c* which are integrally formed on the cylinder head 1 at certain intervals in the axial direction A2 and five cam holders 22 to 24 fastened to the respective supporting walls 1*a* to 1*c*.

The supporting walls la to 1*c* and the cam holders 22 to 24 are constituted by two sets of end supporting walls 1*a*, 1*c* and end cam holders 22, 24 which are situated closer to the end portions of the cylinder head 1 in the axial direction A2 and three sets of intermediate supporting walls 1*b* and intermediate cam holders 23 which are situated, respectively, at the center of the adjacent cylinders C1, C2; C2, C3; C3, C4. As shown in FIG. 1, semi-cylindrical grooves 25*a*, 25*b* are formed on mating surfaces of the respective supporting walls 1*a* to 1*c* and cam holders 22 to 24 which form bearing holes 25 in which journal portions of the camshaft 20 are rotatably supported when the mating surfaces are fastened together.

Fastening portions 28, 29; 30, 31; 32, 33 each having a through hole 27 (a through hole 27 for the cam holder 24 is shown in FIG. 1) which has a center axis L4 which is parallel to the center axis A1 are formed in the respective cam holders 22 to 24 as pairs of holder fastening portions. The fastening portions 28, 29; 30, 31; 32, 33 are spaced apart in the orthogonal direction A3 which is a direction which intersects at right angles with the axial direction A2 when viewed from the plane and are located at positions which correspond to threaded holes 26 (threaded holes 26 in the supporting wall 1*a* are shown in FIG. 1) formed in the supporting walls 1*a* to 1*c*. Thus, the supporting walls 1*a* to 1*c* and the cam holders 22 to 24 are fastened together with bolts B2 which are fastening members adapted to pass through the through holes 27 in the fastening portions 28, 29; 30, 31; 32, 33 to be screwed into the threaded holes 26. Here, the center axis of the bolt B2 matches the center axis L4.

As shown in FIG. 3, the camshaft 20 for each of the cylinders C1 to C4 has an intake cam 34, an exhaust cam 35, an intake-pause cam 36 and an exhaust-pause cam 37. The intake-pause cam 36 and the exhaust-pause cam 37 are provided between the intake cam 34 and the exhaust cam 35 along the camshaft 20 with the intake-pause cam 36 being situated adjacent to the intake cam 34 whereas the exhaust-pause cam 37 being situated adjacent to the exhaust cam 35. The intake cam 34 and the exhaust cam 35 each have a cam profile having an arc-like base rounded portion formed about the rotational axis L2 of the camshaft 20 and a nose portion which protrudes radially outwardly from the base rounded portion, whereby when the internal combustion engine is normally operated, the intake valves 8 and the exhaust valves 9 are actuated to open and close at predetermined opening and closing timings with predetermined lift amounts. The intake-pause cam 36 and the exhaust-pause cam 37 each have a circular cam profile having the same radius as that of the base rounded portions of the intake and exhaust cams 34, 35 and formed about the rotational axis of the camshaft 20, whereby the intake valves 8 and the exhaust valves 9 are maintained in a closed state when the operation of the internal combustion engine is paused.

A rocker shaft 40, which is a shaft member having a center axis L5 which is parallel to the rotational axis L2 of the camshaft 20, passes through a through hole 41 formed directly above the grooves 25*b* in the respective cam holders 22 to 24 and is prevented from rotating and moving in the axial direction A2 by two bolts B3 (refer to FIG. 2) which screw into the cam holders 22, 24 at the both end portion.

Figure 4:
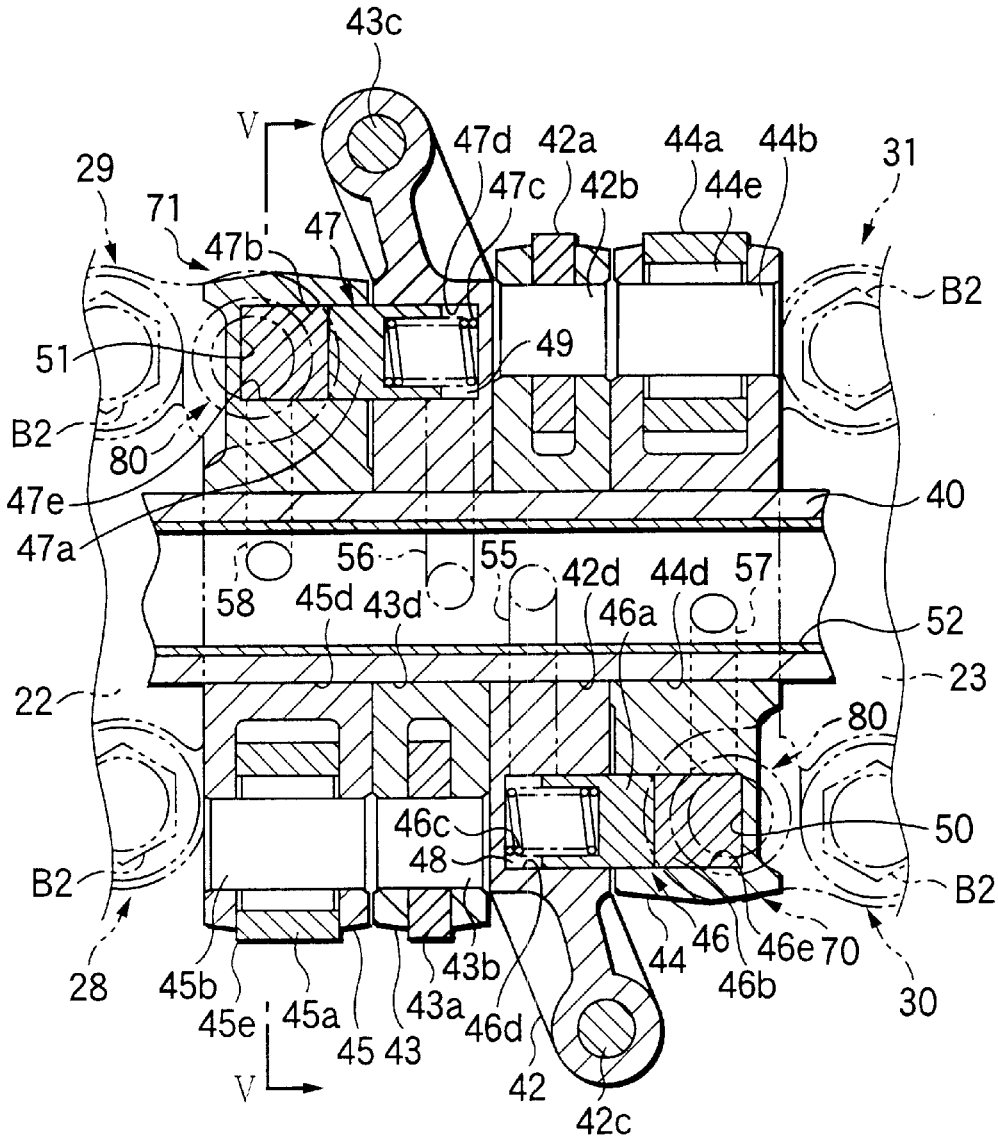
FIG. 4 is a sectional view taken along the line IV—IV in FIG. 5 which shows an intake rocker arm and an exhaust rocker arm.
Figure 5:
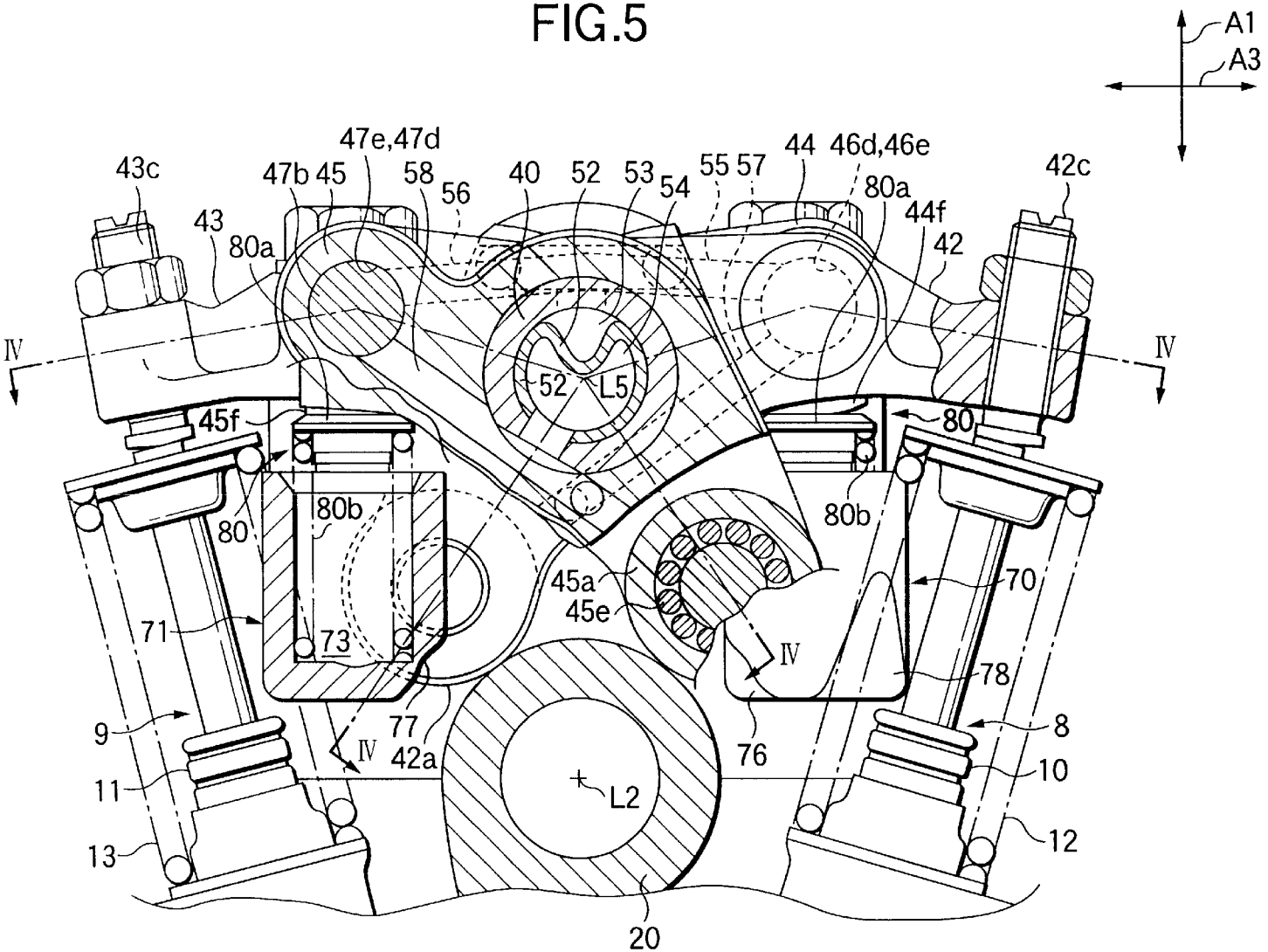
FIG. 5 is a sectional view taken along the line V—V in FIG. 4.

Referring to FIGS. 4 and 5, for each of the cylinders C1 to C4, the rocker shaft 40 includes four rocker arms rockingly supported thereon in a parallel state between the two adjacent cam holders 22, 23; 23, 23; 23, 24 in an axial direction of the rocker shaft 40, that is, in the axial direction A2. The four rocker arms are constituted by an intake drive rocker arm 42 and an exhaust drive rocker arm 43 which are situated adjacent to each other, an intake free rocker arm 44 which is situated on a side of the intake drive rocker arm 42 and closer to the cam holder 23 and an exhaust free rocker arm 45 which is situated on a side of the exhaust drive rocker arm 43 and closer to the other cam holder 22. In addition, FIG. 4 shows a cross-sectional view of the rocker arms 42 to 45 which are disposed between the adjacent cam holders 22, 23.

The intake drive rocker arm 42A has one end portion rotatably supporting a roller 42*a* adapted to be brought into roll contact with the intake-pause cam 36 via a supporting shaft 42*b*, the other end portion with a tappet screw 42*c* adapted to brought into abutment with a valve stem end portion of the intake valve 8 in such a manner as to freely be screwed into and out of the other end portion thereof, and an intermediate portion having a supporting hole 43*d* through which the rocker shaft 40 is allowed to pass. With this construction, the intake drive rocker arm 42 is interlockingly connected to the intake valve 8 so as to drive to open the same.

On the other hand, the intake free rocker arm 44 has one end portion rotatably supporting a roller 44*a* adapted to be brought into roll contact with the intake cam 34 via a support shaft 44*b* and a number of needles 44*e*, the other end portion with an abutment portion 44*f* (refer to FIG. 5) with which an abutment piece 80*a* of a lost motion mechanism 80, which will be described later, is brought into abutment, and an intermediate portion having a supporting hole 44*d* through which the rocker shaft 40 is allowed to pass.

Similarly, the exhaust drive rocker arm 43 includes one end portion rotatably supporting a roller 43*a* adapted to be brought into roll contact with the exhaust-pause cam 37 via a supporting shaft 43*b*, the other end portion with a tappet screw 43*c* adapted to brought into abutment with a valve stem end portion of the exhaust valve 8 in such a manner as to freely be screwed into and out of the other end portion thereof, and an intermediate portion having a supporting hole 43*d* through which the rocker shaft 40 is allowed to pass. With this construction, the exhaust drive rocker arm 43 is interlockingly connected to the exhaust valve 9 so as to drive to open the same.

On the other hand, the exhaust free rocker arm 45 includes one end portion rotatably supporting a roller 45*a* adapted to be brought into slide contact with the exhaust cam 35 via a support shaft 45*b* and a number of needles 45*e*, the other end portion with an abutment portion 45*f* (refer to FIG. 5) with which the abutment piece 80*a* of the lost motion mechanism 80 is brought into abutment, and an intermediate portion having a supporting hole 45*d* through which the rocker shaft 40 is allowed to pass.

Referring to FIG. 4, a connection switching mechanism 46 is provided in such a manner as to straddle between the intake drive rocker arm 42 and the intake free rocker arm 44 for switching over the connection and release of connection of the intake drive rocker arm 42 and the intake free rocker arm 44. On the other hand, a connection switching mechanism 47 is provided in such a manner as to straddle between the exhaust drive rocker arm 43 and the exhaust free rocker arm 45 for switching over the connection and release of connection of the exhaust drive rocker arm 43 and the exhaust free rocker arm 45. The respective connection switching mechanisms 46, 47 which are constituent components of the valve train include connecting pistons 46*a*, 47*a*, release pistons 46*b*, 47*b*, and return springs 46*c*, 47*c*. The connecting pistons 46*a*, 47*a* connect the intake and exhaust drive rocker arms 42, 43 with the intake and exhaust free rocker arms 44, 45, respectively. The release pistons 46*b*, 47*b* restrict the movement of the connecting pistons 46*a*, 47*a* when brought into abutment with the connecting pistons 46*a*, 47*a* and put the connecting pistons 46*a*, 47*a* into a connection released state, respectively. The return springs 46*c*, 47*c* bring the connecting pistons 46*a*, 47*a* into abutment with the release pistons 46*b*, 47*b*, respectively.

Bottomed guide holes 46*d*, 47*d* in which the connecting pistons 46*a*, 47*a* are allowed to slidably fit are formed in the intake and exhaust drive arms 42, 43, respectively, first hydraulic chambers 48, 49 are formed between the connecting pistons 46*a*, 47*a* and the guide holes 46*d*, 47*d*, and furthermore, the return springs 46*c*, 47*c* are accommodated in the first hydraulic chambers 48, 49. In addition, formed in the free rocker arms 44, 45 are bottomed guide holes 46*e*, 47*e* into which the connecting pistons 46*a*, 47*a* and release pistons 46*b*, 47*b* are slidably fitted, and second hydraulic chambers 50, 51 are formed between the release pistons 46*b*, 47*b* and the guide holes 46*e*, 47*e*.

In addition, each of the return springs 46*c*, 47*c* has a spring-back force for biasing the connecting pistons 46*a*, 47*a* so that the intake and exhaust rocker arms 42, 43 and the intake and exhaust free rocker arms 44, 45 are put in a connected state, respectively, when equal pressures which are equal to or lower than a certain low hydraulic pressure are exerted to the first and second hydraulic pressure chambers 48, 50; 49, 51. Accordingly, in the event that no appropriate hydraulic pressure can be obtained, the intake valve 8 and the exhaust valve 9 are opened and closed by the intake cam 34 and the exhaust cam 35, respectively, so that the internal combustion engine is allowed to perform a normal operation.

On the other hand, a pipe 52 is inserted in a cylindrical hollow portion of the rocker shaft 40, so that a first hydraulic fluid path 53 which is formed between the pipe 52 and the rocker shaft 40 and a second hydraulic fluid path 54 which is formed by a hollow portion in the pipe 52 are partitioned and formed in the hollow portion of the rocker shaft 40. The first hydraulic chambers 48, 49 normally communicate with the first hydraulic fluid path 53 via communicating paths 55, 56 constructed by holes formed in the intake and exhaust drive rocker arms 42, 43, whereas the second hydraulic chambers 50, 51 normally communicate with the second hydraulic fluid path 54 via communicating paths 57, 58 constructed by holes formed in the intake and exhaust free rocker arms 44, 45 and holes formed in the pipe 52.

As shown in FIGS. 2 and 3, the first and second hydraulic fluid paths 53, 54 communicate with a high pressure fluid path which communicates with a discharge port of an oil pump (not shown) or a drain fluid path, by an oil pressure control valve 63 comprising a spool valve attached to the cylinder head 1 via two communicating paths 59, 60 formed in the cam holder 24 and two communicating paths 61 62 formed in the cylinder head 1, respectively. The oil pressure control valve 63 is controlled according to the operating conditions of the vehicle to control the hydraulic pressures of the first and second hydraulic fluid paths 53, 54. When the vehicle is driven to operate by only the electric motor as when the vehicle is started from a standstill state or when the vehicle is decelerated, the hydraulic pressure of the first hydraulic fluid path 53 becomes low whereas the hydraulic pressure of the second fluid path 54 becomes high, while when the vehicle is operated otherwise, the hydraulic pressure of the first hydraulic fluid path 53 becomes high whereas the hydraulic pressure of the second hydraulic path 54 becomes low.

Referring to FIG. 2, the pairs of fastening portions 28, 29; 30, 31; 32, 33 on the respective cam holders 22 to 24 are disposed on the intake valve 8 side and the exhaust valve 9 side in relation to the imaginary plane P1. Of those cylindrical portions, cylindrical holding portions 70, 71 are integrally formed on the fastening portions 29 to 32, whereby the cam holders 22 to 24 are each formed as a cam holder with a holding portion.

The holding portions 70, 71 are formed such that the holding portion 71 is formed on the fastening portion 29 of only one, which is situated on the exhaust side, of the camholders 22 provided on the one end of the cylinder head 1, that the holding portion 70 is formed on the fastening portion 32 of only one, which is situated on the intake side, of the cam holders 24 provided on the other end of the cylinder head 1 and that the holding portions 70, 71 are formed on the fastening portions 30, 31, which are situated on the intake side and exhaust side, respectively, of the three intermediate cam holders 23 at positions which hold the rocker shaft 40 and the camshaft 20 therebetween, that is, in such a manner that the rocker shaft 40 and the camshaft 20 are located between both the holders 70, 71 in the orthogonal direction A3. In addition, the holding portions 70 on the intake side are situated on one side, which is a left side 23*a*, 24*a* of the respective cam holders 23, 24 whereas the holding portions 71 on the exhaust side are situated on the other side, which is a right side 22*a*, 23*a* of the respective cam holders 22, 23.

The holding portions 70 formed on the intake side fastening portions 28, 30, 32 for the respective cylinders C1 to C4 are formed in such a manner as to protrude leftward from the fastening portions 28, 30, 32 to the intake free rocker arm 44 side in the axial direction A2 in relation to the adjacent cam holders 22, 23; 23, 23; 23, 24. And, the respective holding portions 70 are formed with bottomed holding holes 72 having center axes L6 which are parallel to the center axis L4 of the through hole 27 and adapted to accommodate and hold therein lost motion mechanisms 80 which are biasing member designed to abut with the abutment portions 44*f* of the intake free rocker arms 44. To be more specific, referring also to FIG. 6, the respective holding portions 70 on the intake side of the respective cam holders 23, 24 protrude in the axial direction A2 from left sides 23*a*, 24*a* of the respective cam holders 23, 24 which are one of the both sides thereof in the axial direction A2, which are situated between the pairs of fastening portions 30, 31; 32, 33 in the orthogonal direction A3. Parts 72*a* of the holding holes 72 which are closer to the fastening portions 30, 32, respectively, are situated closer to right sides 23*b*, 24*b* of the respective cam holders 23, 24, which are one of the sides thereof, than the left sides 23*a*, 24*a* in the axial direction A2.

Similarly, the holding portions 71 formed on the respective fastening portions 29, 31, 33 on the exhaust side for the respective cylinders C1 to C4 are formed in such a manner as to protrude from the fastening portions 29, 31, 33 to the exhaust free rocker arm 45 side in the axial direction A2 in relation to the adjacent cam holders 22, 23; 23, 23; 23, 24. And, the respective holding portions 71 are formed with bottomed holding holes 73 having center axes L7 which are parallel to the center axis L4 of the through hole 27 and adapted to accommodate and hold therein lost motion mechanisms 80 which are designed to abut with the abutment portions 45*f* of the exhaust free rocker arms 45. The respective holding portions 71 on the exhaust side of the respective cam holders 23, 24 protrude in the axial direction A2 from right sides 22*b*, 23*b* of the respective cam holders 22, 23, which are the other sides of the both sides thereof in the axial direction A2, which are situated between the pairs of fastening portions 28, 29; 30, 31 in the orthogonal direction A3. Parts 73*a* of the holding holes 73 which are closer to the fastening portions 29, 30, respectively, are situated closer to left sides 22*b*, 23*b* of the respective cam holders 22, 23 than the right sides 22*a*, 23*a* in the axial direction A2.

In addition, the center axes L6 of the intake side holding portions 70 and the center axes L4 of the intake side fastening portions 28, 30, 32 are situated substantially on straight lines which are parallel to the axial direction A2 as viewed from the plane, and similarly, the center axes L7 of the exhaust side holding portions 71 and the center axes L4 of the exhaust side fastening portions 29, 31, 33 are situated substantially on straight lines which are parallel to the axial direction A2 as viewed from the plane. Furthermore, as shown in FIG. 5, these holding portions 70, 71 are disposed within a space formed between the intake valve 8 and the exhaust valve 9 in the orthogonal direction A3 and between the camshaft 20 and the rocker shaft 40 in the center axis direction A1.

As shown in FIG. 5, the respective lost motion mechanisms 80 which are constituent components of the valve train include abutment pieces 80*a* adapted to abut with the abutment portions 44*f*, 45*f* of the intake and exhaust free rocker arms 44, 45 and springs 80*b* comprising compression coil springs which are spring-back members adapted to hold the abutment pieces 80*a* at one end thereof and to abut with bottom walls of the holding portions 70, 71 at the other end thereof. Then, the rollers 44*a*, 45*a* of the intake and exhaust free rocker arms 44, 45 are biased by virtue of the spring-back force of the springs 80*b* of the lost motion mechanisms 80 in such a manner as to be brought into contact with the intake cam 34 and the exhaust cam 35.

Figure 6:
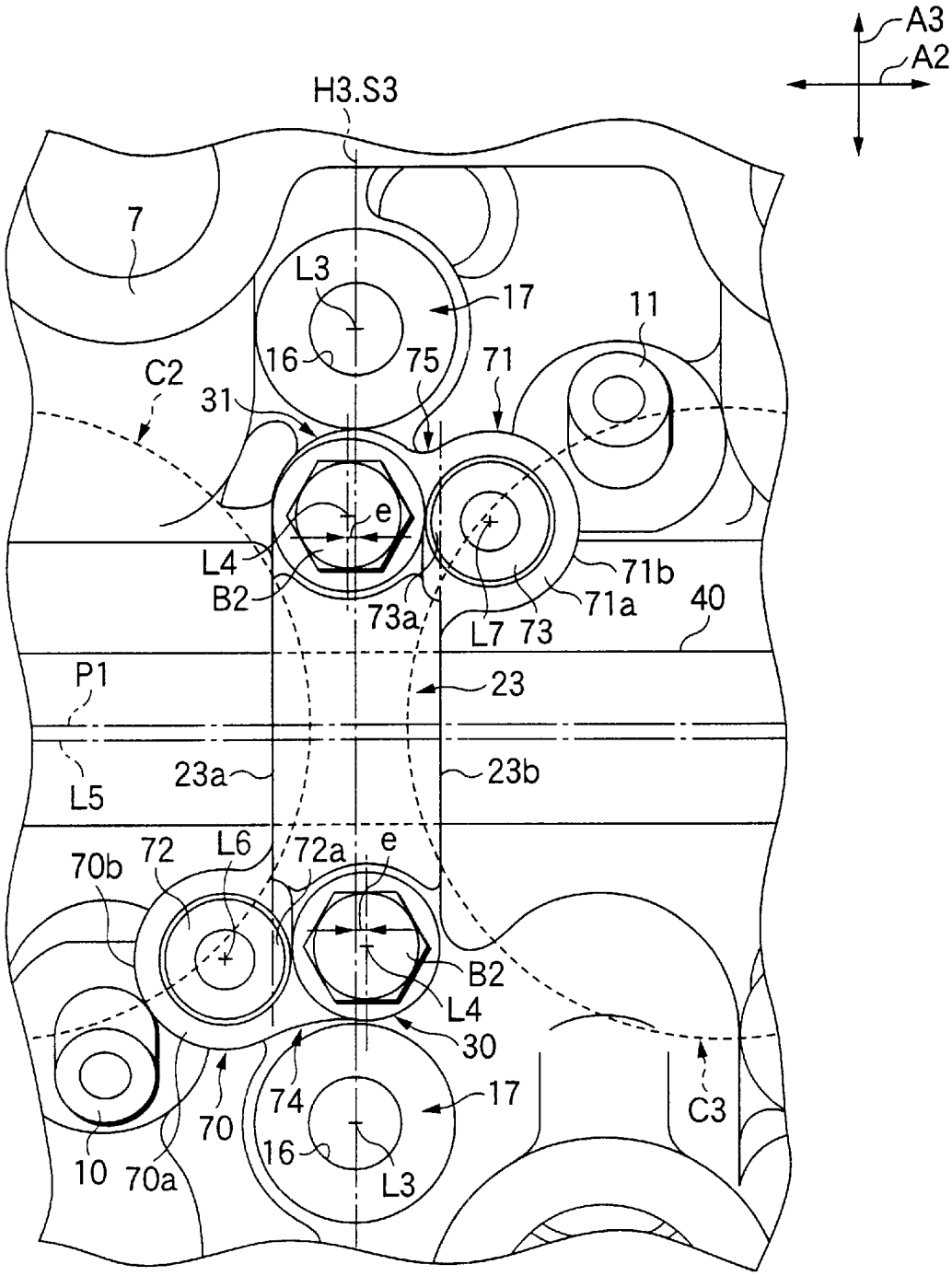
FIG. 6 is a partially enlarged view of FIG. 2.

Referring to FIGS. 2 and 6, on the respective cam holders 22 to 24, the center axes L4 of the fastening portions 30, 32 on which the holding portions 70 are formed, and the center axes L4 of the fastening portions 29, 31 on which the holding portions 71 are formed, are respectively situated on opposite sides of the fastening portions 30, 32 to sides thereof where the holding portions 70 are situated and on opposite sides of the fastening portions 29, 31 to sides thereof where the fastening portions 71 are situated, in such a manner as to be offset by a predetermined distance "e" in relation to reference straight lines S1 to S5 (the reference straight lines S1 to S5 are situated on reference planes H1 to H5 in this embodiment). Here, the reference straight lines S1 to S5 pass through center points in the axial direction A2 between the center axes L4 of the intake side fastening portions 28, 30, 32 and the center axes L4 of the exhaust side fastening portions 29, 31, 33, as viewed from the plane, and are parallel to the orthogonal direction A3. Owing to this, the intake side fastening portions 30, 32 where the holding portions 70 are formed are offset rightward in relation to the corresponding reference straight lines S2 to S5 (or the reference planes H2 to H5) whereas the fastening portions 29, 30 where the holding portions 71 are formed are offset leftward in relation to the reference straight lines S1 to S4 (or the reference planes H1 to H5) Thus, in the respective cylinders C1 to C4, the space in the axial direction A2 between the two holding portions 70, 71 can be increased by a distance equal to the offset distance relative to the set distance between the two adjacent reference planes H1, H2; H2, H3; H3, H4; H4, H5.

In addition, the respective cylindrical holding portions 70, 71 having the center axes L6, L7 which are parallel to the center axes L4 of the through holes 27 have side walls 70*a*, 71*a* which extend substantially in parallel to the tightening direction of the bolt B2, that is, a center axis direction of the bolt B2 or the center axis direction A1. Thus, the respective holding portions 70, 71 are allowed to connect to the fastening portions 30, 32, 29, 31, respectively, along the full length thereof in the center axis direction A1, and furthermore, outer circumferential surfaces 70*b*, 71*b* of the holding portions 70, 71 are substantially parallel to the center axis direction A1. Moreover, there is almost no possibility that the respective holding portions 70, 71 protrude from the respective fastening portions 29 to 32 in the orthogonal direction A3.

Then, recessed portions 74, 75 are formed in the fastening members 29 to 32 and holding members 70, 71 which are provided at end portions of the cam holders 22 to 24 in the orthogonal direction A3 between the fastening portions 29 to 32 and the holding portions 70, 71 by the sides of the fastening portions 29 to 32 and the holding portions 70, 71 in the orthogonal direction A3. The recessed portions 74, 75 are curved towards central portions of the cam holders 22 to 24 in the orthogonal direction A3 and extend along the both center axes L4, L6 or the both center axes L4, L7.

Figure 7:
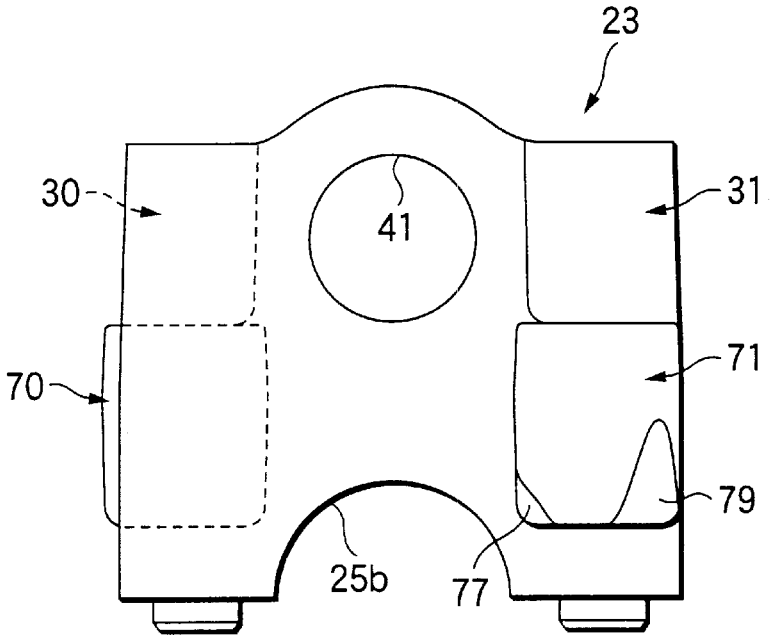
FIG. 7 is a side view of a cam holder.
Figure 8:
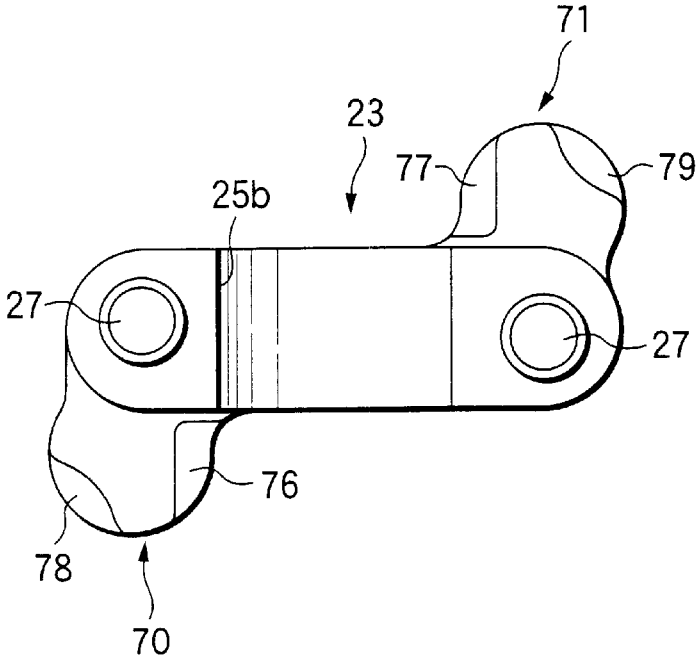
FIG. 8 is a bottom view of the cam holder shown in FIG. 7.

Furthermore, as shown in FIGS. 5, 7 and 8, notched portions 76, 77 for allowing the rotation of the intake cam 34 and the exhaust cam 35, and notched portions 78, 79 for avoiding the interference with the valve springs 12, 13 are formed in the holding portions 70, 71, respectively.

Next, the function and effectiveness of the embodiment which is constructed as has been described heretofore will be described.

When the vehicle is driven to operate only by the electric motor as in a case where the vehicle starts from a standstill or when the vehicle is decelerated, the first hydraulic fluid path 53 is allowed to communicate with the drain fluid path via the communication paths 59, 61 by the hydraulic pressure control valve 63, whereby the hydraulic fluid in the first hydraulic fluid path 53 has a low hydraulic pressure whereas the second hydraulic fluid path 54 is allowed to communicate with the aforesaid highly pressurized fluid path via the communication paths 60, 62 by the hydraulic pressure control valve 63, whereby the hydraulic fluid in the second hydraulic fluid path 54 has a high hydraulic pressure. As a result, the first hydraulic chambers 48, 49 have a low hydraulic pressure whereas the second hydraulic pressure chambers 50, 51 has a high hydraulic pressure. Therefore, when the intake and exhaust free rocker arms 44, 45 are in contact with the base rounded portions of the intake and exhaust cams 34, 35, the release pistons 46*b*, 47*b* push on the connecting pistons 46*a*, 47*a* by virtue of a difference in hydraulic pressure between the first and second hydraulic chambers 48, 50; 49, 51, so that the abutment surfaces between the connecting pistons 46*a*, 47*a* and the release pistons 46*b*, 47*b* is allowed to be situated between the intake and exhaust drive rocker arms 42, 43 and the intake and exhaust free rocker arms 44, 45. Then, the intake and exhaust drive rocker arms 42, 43 and the intake and exhaust free rocker arms 44, 45 are put in the connection released state from the state shown in FIG. 4. Thus, the rocking action of the intake and exhaust drive rocker arms 42, 43 are regulated by the profiles of the intake-pause and exhaust-pause cams 36, 37, respectively, whereby the intake valve 8 and the exhaust valve for each of the cylinders C1 to C4 is put in the valve-closed state, the internal combustion engine being thereby put in a pause-operation state.

In this pause-operation state, the crankshaft and the camshaft 20 are caused to turn by the power from the electric motor and the tires or the inertia force thereof. As this occurs, while the intake and exhaust free rocker arms 44, 45 which perform the rocking action regulated by the cam profiles of the intake and exhaust cams 34, 35, respectively, are in a free state relative to the intake valve 8 and the exhaust valve 9, the intake and exhaust free rocker arms 44, 45 are biased toward the intake cam 34 and the exhaust cam 35, respectively, in a spring-back fashion by the lost motion mechanisms 80 so as to be brought into contact with those cams, to thereby prevent the generation of abnormal noises which would otherwise be caused by the rough action of the intake and exhaust free rocker arms 44, 45 or collision thereof with both the intake and exhaust cams 34, 35.

Then, when the vehicle is put in the normal driving state which requires the vehicle to be driven by the internal combustion engine, the hydraulic control valve 63 controls such that the first hydraulic fluid path 53 communicates with the highly pressurized fluid path via the communication paths 59, 61, so that the hydraulic fluid in the first hydraulic fluid path 53 has a high hydraulic pressure and that the second hydraulic fluid path 54 communicates with the drain fluid path via the communication paths 60, 62, so that the hydraulic fluid in the second hydraulic fluid path 54 has a low hydraulic pressure. As a result, the first hydraulic chambers 48, 49 has a high hydraulic pressure whereas the second hydraulic chambers 50, 51 has a low hydraulic pressure, whereby when the intake and exhaust free rocker arms 44, 45 are in contact with the base rounded portions of the intake and exhaust cams 34, 35, the connecting pistons 46*a*, 47*a* push on the release pistons 46*b*, 47*b* by virtue of a difference in hydraulic pressure between the first and second hydraulic chambers 48, 50; 49, 51, and as shown in FIG. 4, the abutment surfaces between the connecting pistons 46*a*, 47*a* and the release pistons 46*b*, 47*b* are situated within the guide holes 46*e*, 47*e*, whereby the intake and exhaust drive rocker arms 42, 43 and the intake and exhaust free rocker arms 44, 45 are put in the connected state. Thus, the rocking action of the intake and exhaust drive rocker arms 42, 43 are regulated by the cam profiles of the intake and exhaust cams 34, 35, the intake valve 8 and the exhaust valve 9 being thereby opened and closed at the predetermined timings and in the predetermined amounts.

Then, the holding portions 70, 71 holding the lost motion mechanisms 80 are fastened by the pairs of fastening portions 28 to 33 provided on the cylinder head 1 in such a manner as to be spaced apart in the orthogonal direction A3 as viewed from the plane and are formed into the cam holders 22 to 24 for supporting the camshaft 20 and the rocker shaft 40 which are the constituent components of the valve train. Accordingly, the construction of the cylinder head is simplified so as to increase the productivity of cylinder heads 1. Moreover, since no member needs to be separately prepared and attached for the formation of the holding portions 70, 71, the number of components is decreased to thereby improve the assembling performance of internal combustion engines, and at the same time this allows the production of internal combustion engines which are small in size and light in weight.

Furthermore, since the fastening portions 29 to 32 with which the holding portions 70, 71 are formed integrally are the portions where the cam holders 22 to 24 are bolted to the cylinder head 1 with the bolts B2, the deformation is extremely small which is generated in the fastening portions 29 to 32 on which the holding portions 70, 71 are formed, due to loads exerted on the holding portions 70, 71 from the intake and exhaust free rocker arms 44, 45 which are pushed by the intake and exhaust cams 34, 35 via the lost motion mechanisms 80, thereby making it possible to exert the stable spring-back force in a predetermined direction on the intake and exhaust free rocker arms 44, 45. Thus, since the deformation amount of the cam holders 22 to 24 that would be generated by the loads exerted on the holding portions 70, 71 is made to be as small as possible, there is almost no need to form the cam holders 22 to 24 thicker or to form reinforcement ribs that would otherwise be needed to cope with the formation of the holding portions 70, 71. Thus, the cam holders 22 to 24 can be made small in size and light in weight, this eventually leading to an engine which is small in size and light in weight. Moreover, the fastening rigidity of the fastening portions 29 to 32 is further increased by the integral formation with the holding portions 70, 71.

In the two adjacent cam holders 22, 23; 23, 23; 23, 24 provided in such a manner as to interpose therebetween the four rocker arms including the intake and exhaust drive rocker arms 42, 43 and the intake and exhaust free rocker arms 44, 45 and adjacently arranged in the axial direction A2, the center axes or center axes L4 of the bolts B2 of the fastening portions 29 to 32 where the holding portions 70, 71 are formed, are situated at the opposite positions to the holding portions 70, 71 in relation to the reference straight lines S1 to S5. Therefore, the spaces in the axial direction A2 between the holding portions 70, 71 and the cam holders 22 to 24 which confront the holding portions 70, 71 can be increased, and further, the spaces in the axial direction A2 of the holding portions 70, 71 can be increased. Accordingly, a sufficient space for disposing the four rocker arms can be secured while realizing a cylinder head which is small in size and light in weight without increasing the space in the axial direction A2 between the adjacent cam holders 22, 23; 23, 23; 23, 24 or the width in the axial direction A2 of the cylinder head 1.

Since the intake and exhaust free rocker arms 44, 45 are disposed near the cam holders 22 to 24 in the axial direction A2, the protruding amount from the cam holders 22 to 24 in the axial direction A2 of the holding portions 70, 71 on which the lost motion mechanisms 80 are provided for biasing the intake and exhaust free rocker arms 44, 45 in the spring-back fashion can be kept small, and therefore, in this respect, the cam holders 22 to 24 can also be made small in size and light in weight, this eventually leading to an internal combustion engine which is small in size and light in weight.

Since the side walls 70*a,* 71*a* of the holding portions 70, 71 are formed in such a manner as to extend along the tightening direction of the bolts B2, the side walls 70*a,* 71*a* are allowed to connect to the fastening portion 28 along the full length thereof in the center axis direction A1 of the holding portions 70, 71, the connecting range thereof can be set larger in the tightening direction. Thus, the deformation amount of the cam holders 22 to 24 due to the loads exerted on the holding portions 70, 71 can be made smaller, and the rigidity of the fastening portions 29 to 32 in the vicinity of the holding portions 70, 71 does not have to be increased. Therefore, the cam holders 22 to 24 can be made small in size and light in weight, this leading eventually to an internal combustion engine which is small in size and light in weight. Moreover, the fastening rigidity of the fastening portions 29 to 32 can further be increased owing to the integral formation with the holding portions 70, 71 thereon.

In the intermediate holders 23, the holding portions 70, 71 are formed on the intake side fastening portions 30, 32 and the exhaust side fastening portions 29, 31 at the positions which hold the camshaft 20 and the rocker shaft 40 therebetween, and loads exerted on the respective holding portions 70, 71 from the intake and exhaust free rocker arm 44, 45 which are pushed by the intake and exhaust cams 34, 35 are exerted at the positions on the cam holders 23 which interpose the camshaft 20 and the rocker shaft 40 and are spaced apart in the orthogonal direction A3 and, moreover, on the both sides in the axial direction A2. Therefore, the working points of the loads acting on the cam holders 23 can be dispersed to thereby decrease a stress that is generated by the loads so exerted, whereby the design in strength of the cam holders 23 can be facilitated, and moreover, the durability of the cam holders 23 can also be increased.

The recessed portions 74, 75 are formed between the fastening portions 30, 32 and the holding portion 70 and between the fastening portions 29, 31 and the holding portion 71, and furthermore, the notched portions 76, 77 and the notched portions 78,79 are formed in the holding portions 70, 71 for avoiding the interference with the intake cam 34 and the exhaust cam 35 and for avoiding the interference with the valve springs 12, 13, respectively, whereby the cam holders 22 to 24 can be made small in size and light in weight, this eventually leading to an interval combustion engine which is small in size and light in weight.

The part 72*a* of the holding hole 72 of the intake side holding portion 70 which are formed in the left-hand side of the respective cam holders 23, 24 are situated closer to the right sides 23*b,* 24*b* of the cam holders 23, 24 than the left sides 23*a,* 24*a* thereof whereas the part 73*a* of the exhaust side holding hole 71 which are formed in the right-hand side of the respective cam holders 22, 23 are situated closer to the left sides 22*a,* 23*a* of the cam holders 23, 24 than the right sides 22*b* and 23*b* thereof. Therefore, the protruding amount of the holding portion 70 which protrudes leftwards in the axial direction A2 from the left sides 23*a,* 24*a* of the respective cam holders 23, 24 and the holding portion 70 which protrudes rightwards in the axial direction A2 from the right sides 22*b,* 23*b* of the respective cam holders 22, 23 can suppressed, whereby the width in the axial direction A2 of the cam holders 22 to 24 can be decreased, and the cam holders 22 to 24 can be made lighter in weight, and moreover, the width in the axis of the cylinder head 1 is also decreased, whereby the cylinder head 1 is made small in size and light in weight, this eventually leading to an internal combustion engine which is small in size and light in weight.

By forming in the holding portions 70, 71 the notched portions 76, 77 for permitting the rotation of intake cam 34 and the exhaust cam 35 and the notched portions 78, 79 for avoiding the interference with the valve springs 12, 13, the holding portions 70, 71 can be disposed as close to the intake cam 34, the exhaust cam 35 and the valve springs 12, 13 as possible. Thus, the space in the axial direction A2 between the adjacent cam holders 22, 23; 23, 23; 23, 24 can extremely be reduced, whereby the width in the axial direction of the cylinder head 1 can be reduced, thereby making it possible to make the cylinder head 1 small in size and light in weight.

Moreover, the holding portions 70, 71 are disposed by making use of the space formed between the intake valve 8 and the exhaust valve 9 in the orthogonal direction A3 and between the camshaft 20 and the rocker shaft 40 in the center axis direction A1, and the notched portions 76, 77 and the notched portions 78, 79 are formed in the holding portions 70, 71. Accordingly, the increase in width of the cylinder head 1 in the orthogonal direction can be suppressed by forming the holding portions 70, 71 on the cam holders 22 to 24, and the width of the cylinder head 1 and furthermore the valve train chamber in the orthogonal direction A3 can be reduced, thereby making it possible to maintain compact the internal combustion engine comprising the valve train comprising in turn the single camshaft 20 and the single rocker shaft 40. Furthermore, the respective holding portions 70, 71 hardly protrude from the fastening portion 28 in the orthogonal direction A3, and in this respect, too, the holding portions 70, 71 can be disposed compact in the aforesaid space.

A modified construction of an embodiment in which the construction of the previous embodiment is partially modified will be described below.

Figure 9:
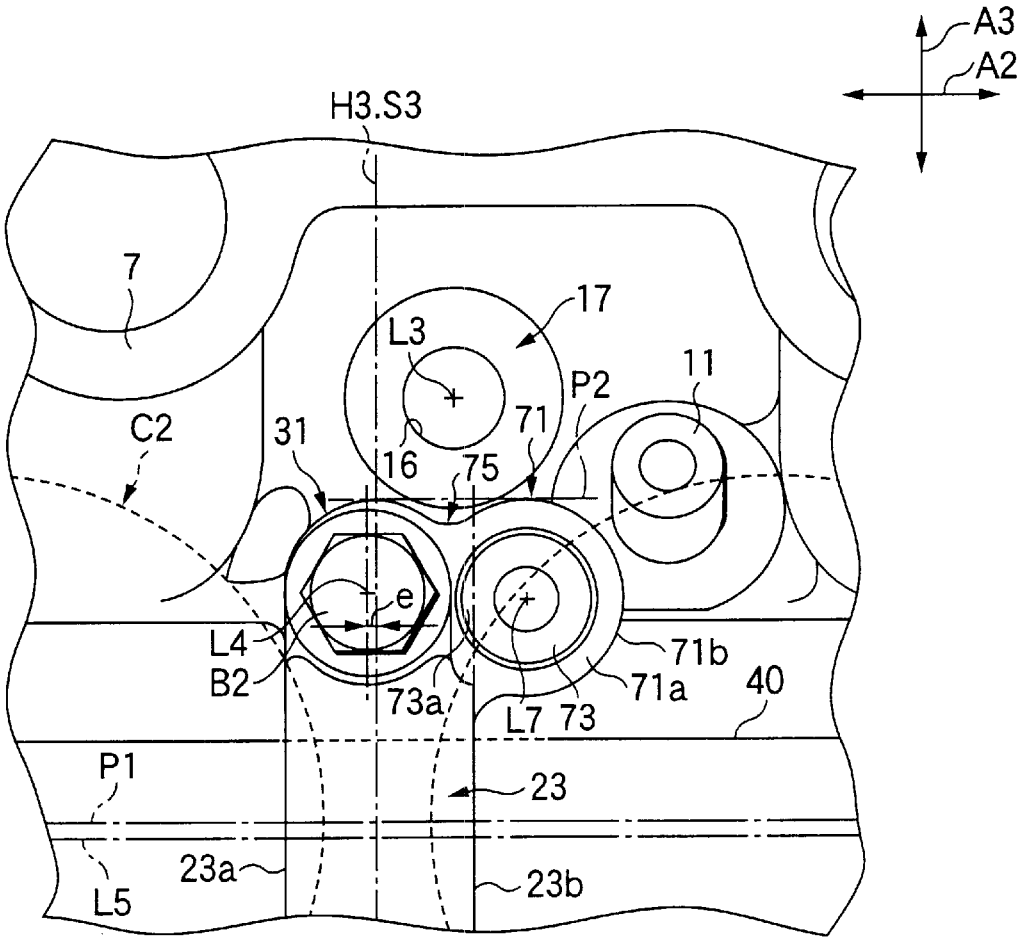
FIG. 9 is a partial plan view showing an embodiment in which the layout of a head fastening portion and the cam holder is modified.

Since the recessed portions 74, 75 are curved toward the central portions in the orthogonal direction A3 of the cam holders 22 to 24 and extend along the center axis L4 to the center axis L7, a space is formed outwardly of the fastening portions 29 to 32 and the holding portions 70, 71 in the orthogonal direction A3 toward the aforesaid central portions by the recessed portions 74, 75. Then, by making use of the space, for example, as shown in FIG. 9, a fastening portion 17' which is a head fastening portion and the cam holder 23 are allowed to come nearer to each other in the orthogonal direction A3, whereby part of the fastening portion 17' can be disposed at a position which is closer to the imaginary plane P1 than the imaginary plane P2 which contacts the side of the fastening portion 31 and the holding portion 71 in the orthogonal direction A3. This arrangement also applies to the other head fastening portions and cam holders, whereby the cylinder head 1 can be made small in size in the orthogonal direction A3 while securing the required width of the cam holders 22 to 24 in the orthogonal direction A3.

In the embodiments, while the internal combustion engine is a hybrid internal combustion engine, the invention can also be applied to a vehicle which uses only an internal combustion engine as a power source. As this occurs, part of cylinders of a multi-cylinder internal combustion engine are made to rest, and only adjacent cam holders interposing the rested cylinder serves as cam holders with a holding portions 70, 71. Moreover, the rocker arms corresponding to the cylinders which are designed not to rest are made to be a rocker arm without a connection switching mechanism, and the intake drive rocker arm and the exhaust drive rocker are driven to open by the intake cam and the exhaust cam.

In the embodiment, while the intake and exhaust drive rocker arms 42, 43 are designed to be brought into contact with the intake-pause and the exhaust-pause cams 36, 37, the intake and exhaust drive rocker arms may be designed such that they are brought into contact with a low-speed cam having a cam profile in which the intake and exhaust rocker arms are designed to open inlet and exhaust valves at the predetermined timings and in the predetermined amount and the intake and exhaust free rocker arms may be designed such that they are brought into contact with a high-speed cam having a cam profile in which the intake and exhaust free rocker arms open at earlier timings and close at later timings than the low-speed cam and further open the intake valve and the exhaust valve in a greater lift amount than that of the low-speed cam.

While the valve train is a valve train comprising the single rocker shaft 40, the valve train may be an SOHC type valve train comprising two rocker shafts; an intake rocker shaft on which intake rocker arms are supported and an exhaust rocker shaft on which exhaust rocker arms are supported, or may be a DOHC type valve train comprising two camshafts; an intake camshaft and an exhaust camshaft. Furthermore, the holder on which the holding portions 70, 71 are formed may be a holder adapted to hold either of the camshaft shaft and the rocker shaft. In addition, the cam holder may be fastened by three or more fastening portions, and as this occurs, two of those three fastening portions only have to be fastening portions which correspond any of the pairs of fastening portions.

In the embodiment, while the center axes L6 of the holding portions 70 and the center axes L4 of the intake side fastening portions 28, 30, 32 are situated substantially on the straight line which is parallel to the axial direction A2 as viewed from the plane and the center axes L7 of the holding portions 71 and the center axes L4 of the exhaust side fastening portions 29, 31, 33 are situated substantially on the straight line which is parallel to the axial direction A2 as viewed from the plane, the center axes L6 may be situated closer to or farther away from the center axis L5 of the rocker shaft 40 than the center axes L4 of the intake side fastening portions 28, 30, 32 depending upon the positions of the abutment portions 44*f*, 45*f* of the intake and exhaust free rocker arms 44, 45. Similarly, the center axes L7 may be situated closer to or farther away from the center axis L5 of the rocker shaft 40 than the center axes L4 of the exhaust side fastening portions 29, 31, 33.

In the embodiment, while the biasing member is the lost motion mechanism 80 for biasing the intake and exhaust free rocker arms 44, 45 to the intake and exhaust cams 34, 35 sides, a biasing member utilizing the spring-back force of a spring may be used to bias the drive rocker arm to the intake valve or exhaust valve side in a spring-back fashion such that the tappet clearance between the drive rocker arm and the intake valve or the exhaust valve becomes zero. Then, even if this occurs, similar effectiveness to that provided in the previous embodiments can be provided even if the load exerted to the holding portion for holding the biasing member via the biasing member from the drive rocker arm is smaller than that of the lost motion mechanism.

In the embodiment, while the intake and exhaust drive rocker arms 42, 44 and the intake and exhaust free rocker arms 44, 45 are of a roller type in which the rollers 42*a* to 45*a* provided thereon are designed to be brought into contact with the corresponding cams 34 to 37, at least either of the drive rocker arm and free rocker arm may be of a slipper type in which a slipper, instead of the roller, is brought in to contact with the corresponding cam. Furthermore, in the embodiment, while the internal combustion engine 1 is the internal combustion engine in which a single intake valve 8 and a single exhaust valve 9 are provided for each cylinder, there may be an internal combustion engine in which a plurality of intake valves or a plurality of exhaust valves are provided for a cylinder.

What is claimed is:

1. An overhead camshaft type valve train for an internal combustion engine having cylinders, comprising:

a camshaft supported by a plurality of holders provided on a cylinder head;

rocker arms rockingly supported on a rocker shaft for driving engine valves to open;

cams provided on said camshaft for regulating the rocking action of said rocker arms; and biasing members for biasing said rocker arms to either a cam side or an engine valve side, wherein at least one of said plurality of holders is fastened to said cylinder head with fastening members at two fastening portions spaced apart from each other in an orthogonal direction which intersects at right angles with an axial direction of said rocker shaft when viewed from a plane, wherein said at least one of holders includes a holding portion for holding said biasing member, which is integrally formed on at least one of said two fastening portions, and wherein said holding portion is situated on a side of said fastening portion.

2. The overhead camshaft type valve train according to claim 1, wherein said rocker arms comprises an intake rocker arm for driving an intake valve to open and an exhaust rocker arm for driving an exhaust valve to open, and wherein said intake and exhaust rocker arms are rockingly supported by said single rocker shaft.

3. The overhead camshaft type valve train according to claim 1, wherein said holding portion is located below said rocker shaft in a cylinder axial direction.

4. An overhead camshaft type valve train for an internal combustion engine having cylinders, comprising:

a camshaft supported by a plurality of holders provided on a cylinder head;

rocker arms rockingly supported on a rocker shaft for driving engine valves to open;

cams provided on said camshaft for regulating the rocking action of said rocker arms; and biasing members for biasing said rocker arms to either a cam side or an engine valve side, wherein at least one of said plurality of holders is fastened to said cylinder head with fastening members at two fastening portions spaced apart from each other in an orthogonal direction which intersects at right angles with an axial direction of said rocker shaft when viewed from a plane, wherein said at least one of holders includes a holding portion for holding said biasing member, which is integrally formed on at least one of said two fastening portions, and wherein said holding portion overlaps a fastening bolt hole for fastening said holder to said cylinder head when viewed from a camshaft direction.

5. The overhead camshaft type valve train according to claim 4, wherein a center of said holding portion overlaps with a center of said fastening portion when viewed from said camshaft direction.

6. The overhead camshaft type valve train according to claim 4, wherein a side wall of said holding portion located in a direction perpendicular to said camshaft direction is situated on a cylinder side relative to a side wall of said fastening portion of said holder located in the perpendicular direction of said camshaft.

7. The overhead camshaft type valve train according to claim 4, wherein said rocker arms comprises an intake rocker arm for driving an intake valve to open and an exhaust rocker arm for driving an exhaust valve to open, and wherein said intake and exhaust rocker arms are rockingly supported by said single rocker shaft.

8. The overhead camshaft type valve train according to claim 4, wherein said holding portion is located below said rocker shaft in a cylinder axial direction.

9. An overhead camshaft type valve train for an internal combustion engine having cylinders, comprising:

a camshaft supported by a plurality of holders provided on a cylinder head;

rocker arms rockingly supported on a rocker shaft for driving engine valves to open;

cams provided on said camshaft for regulating the rocking action of said rocker arms; and biasing members for biasing said rocker arms to either a cam side or an engine valve side, wherein at least one of said plurality of holders is fastened to said cylinder head with fastening members at two fastening portions spaced apart from each other in an orthogonal direction which intersects at right angles with an axial direction of said rocker shaft when viewed from a plane, and wherein a holding portion for holding said biasing member is situated on a cylinder side relative to a head bolt fastening portion in a direction perpendicular to a camshaft direction.

10. An overhead camshaft type valve train for an internal combustion engine having cylinders, comprising:

a camshaft supported by a plurality of holders provided on a cylinder head;

rocker arms rockingly supported on a rocker shaft for driving engine valves to open;

cams provided on said camshaft for regulating the rocking action of said rocker arms; and biasing members for biasing said rocker arms to either a cam side or an engine valve side, wherein at least one of said plurality of holders is fastened to said cylinder head with fastening members at two fastening portions spaced apart from each other in an orthogonal direction which intersects at right angles with an axial direction of said rocker shaft when viewed from a plane, wherein said at least one of holders includes a holding portion for holding said biasing member, which is integrally formed on at least one of said two fastening portions, wherein said rocker arm is disposed between two of said holders which are adjacent in said axial direction, wherein at least one of said two holders is said holder including said holding portion, and wherein a center axis of said fastening member at said one of said fastening portions on said one of said two holders is situated on an opposite side to a side where said holding portion is situated, relative to a reference straight line of said two fastening portions, said reference straight line passing through a center point in said axial direction between the center axis of said fastening member at said one of said fastening portions on said one of said two holders and a center axis of said fastening member at the other fastening portion of said two fastening portions as viewed from the plane and being parallel to said orthogonal direction.

11. The overhead camshaft type valve train according to claim 10, wherein a side wall of said holding portion extends along a fastening direction of said fastening member.

12. The overhead camshaft type valve train according to claim 11, wherein said holding portions are formed on said two fastening portions at positions which interpose said camshaft therebetween, and wherein one of said holding portions is situated on one side of said holder in said axial direction whereas the other holding portion is situated on the other side of said holder in said axial direction.

13. The overhead camshaft type valve train according to claim 12, wherein a recessed portion is formed between said fastening portion and said holding portion.

14. The overhead camshaft type valve train according to claim 11, wherein a recessed portion is formed between said fastening portion and said holding portion.

15. The overhead camshaft type valve train according to claim 11, wherein said holding portion protrudes in said axial direction from one of side surfaces of said axial direction situated between said two fastening portions provided on said holder including said holding portion, and wherein a part of a holding hole formed in said holding portion for accommodation of said biasing member is situated closer to the other side surface of said holder in said axial direction than said one of side surfaces of said holder.

16. The overhead camshaft type valve train according to claim 10, wherein said holding portions are formed on said two fastening portions at positions which interpose said camshaft therebetween, and wherein one of said holding portions is situated on one side of said holder in said axial direction whereas the other holding portion is situated on the other side of said holder in said axial direction.

17. The overhead camshaft type valve train according to claim 16, wherein a recessed portion is formed between said fastening portion and said holding portion.

18. The overhead camshaft type valve train according to claim 10, wherein a recessed portion is formed between said fastening portion and said holding portion.

19. The overhead camshaft type valve train according to claim 10, wherein, in said holder including said holding portion, said holding portion protrudes in said axial direction from one of two side surfaces of said holder situated between said two fastening portions in said axial direction, and wherein a part of a holding hole formed in said holding portion for accommodation of said biasing member is situated closer to the other side surface of said holder in said axial direction than said one of two side surfaces of said holder.

20. The overhead camshaft type valve train according to claim 10, wherein said rocker arms comprises an intake rocker arm for driving an intake valve to open and an exhaust rocker arm for driving an exhaust valve to open, and wherein said intake and exhaust rocker arms are rockingly supported by said single rocker shaft.

21. The overhead camshaft type valve train according to claim 10, wherein said holding portion is located below said rocker shaft in a cylinder axial direction.

22. An overhead camshaft type valve train for an internal combustion engine having cylinders comprising:

a camshaft supported by a plurality of holders provided on a cylinder head;

drive rocker arms mockingly supported on a rocker shaft in such a manner as to be interlockingly connected to respective engine valves comprising an intake valve and an exhaust valve so as to drive said engine valves to open;

free rocker arms supported rockingly on said rocker shaft in such a manner as to have a free condition relative to said engine valves;

cams provided on said camshaft for regulating the rocking actions of said drive rocker arms and said free rocker arms;

connection switching mechanisms for switching over the connection and the release of connection of said drive rocker arms and said free rocker arms; and biasing members for biasing said free rocker arms to a cam side, wherein at least one of said plurality of holders is fastened to said cylinder head with fastening members at two fastening portions spaced apart from each other in an orthogonal direction which intersects at right angles with an axial direction of said rocker shaft when viewed from a plane, wherein said at least one of holders includes a holding portion for holding said biasing member, which is integrally formed on at least one of said two fastening portions, wherein said free rocker arm is disposed closer to said holder including said holding portion in said axial direction than said drive rocker arm, wherein said plurality of holders are respectively arranged between said cylinders, and wherein said drive rocker arms and said free rocker arms are disposed between said plurality of holders in said axial direction of said rocker shaft in such a manner as to contact with each other in said axial direction.

23. The overhead camshaft type valve train according to claim 22, wherein said holding portions are formed on said two fastening portions at positions which interpose said camshaft therebetween, and wherein one of said holding portions is situated on one side of said holder in said axial direction whereas the other holding portion is situated on the other side of said holder in said axial direction.

24. The overhead camshaft type valve train according to claim 23, wherein a recessed portion is formed between said fastening portion and said holding portion.

25. The overhead camshaft type valve train according to claim 24, wherein said recessed portion is curved toward a central portion of said holder in said orthogonal direction and extend along a fastening direction of said fastening member.

* * * * *